US006638409B1

(12) United States Patent
Huang et al.

(10) Patent No.: US 6,638,409 B1
(45) Date of Patent: Oct. 28, 2003

(54) STABLE PLATING PERFORMANCE IN COPPER ELECTROCHEMICAL PLATING

(75) Inventors: Chen-Ming Huang, Taipei (TW); Li-Chuen Cheng, Kaohsiung (TW); Hung-Jen Lin, Tainan (TW); Chih-Chen Ku, Hsin-Chu (TW); San-Sun Yang, Tainan (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 0 days.

(21) Appl. No.: 10/152,471

(22) Filed: May 21, 2002

(51) Int. Cl.[7] ..... C25D 21/18

(52) U.S. Cl. ..... 205/99; 204/238; 204/240; 204/276

(58) Field of Search ..... 205/99, 98; 204/238, 204/240, 276

(56) References Cited

U.S. PATENT DOCUMENTS 4,435,266 A 3/1984 Johnston
5,660,699 A 8/1997 Saito et al.
6,027,631 A 2/2000 Broadbent
6,077,404 A 6/2000 Wang et al.
6,099,702 A 8/2000 Reid et al.
6,156,167 A 12/2000 Patton et al.
6,200,436 B1 * 3/2001 Mei-Chu Woo ..... 204/238
6,254,760 B1 * 7/2001 Shen et al. ..... 205/335
6,284,121 B1 9/2001 Reid
6,501,995 B1 * 12/2002 Kinney et al. ..... 700/1
2001/0042686 A1 * 11/2001 Taniguchi et al. ..... 205/50

* cited by examiner

*Primary Examiner*—Roy King
*Assistant Examiner*—Wesley A. Nicolas
(74) *Attorney, Agent, or Firm*—Tung & Associates

(57) ABSTRACT

A real-time and in-line process control system maintains stable plating performance in copper electrochemical plating IC devices by using a real time, on-line programmable controller. Two or more valves to direct the flow of the electrolyte from the electroplating cell back to the reservoir connect an alternative carbon-filter as well as a mirco-filter. The programmable controller controls the operation of at least two in-line valves to direct the flow of the electrolyte within the system.

9 Claims, 4 Drawing Sheets

STABLE PLATING PERFORMANCE IN COPPER ELECTROCHEMICAL PLATING

FIELD OF THE INVENTION

This invention relates to copper electrochemical plating in general and more particularly to maintaining the stability of the plating electrolyte.

BACKGROUND OF THE INVENTION

In electrochemical copper plating in an IC process, the stability of electrolyte plays an important role on the film property. Some commercial copper plating machines have no working method to solve the maintenance of the electrolyte; they just drain and replace the electrolyte at great cost. Others maintain the purity of the electrolyte by a method that leaks a percentage of the old electrolyte and refreshes the leaked percentage with new electrolyte during the plating process. This method is asserted will maintain a more stable electrolyte property.

U.S. Pat. No. 6,099,702 issued to Reid et al on Aug. 8, 2000 is entitled "Electroplating Chamber with Rotatable Wafer Holder and Pre-wetting and Rinsing Capability" teaches a plating cell with an inner plating bath container. A wafer on a wafer holder is lowered into a position in the inner plating bath to a position below a plating solution level. After electroplating, the wafer is raised and spun so that the spun-off water and plating solution enters either a reclaim or a waste inlet in the plating machine. In this patent the pre-rinse stage returns substantially all of the rinse solution back into the plating solution.

U.S. Pat. No. 5,660,699 issued to Saito et al on Aug. 26, 1997 is entitled "Electroplating Apparatus" teaches a cathode base for supporting a substrate, and a damper for clamping a peripheral edge portion of the substrate together with the cathode base. The plating solution is supplied onto the substrate so that the surface of the substrate is plated. A negative pressure source clamps the substrate by drawing the damper under a negative pressure through a suction conduit.

U.S. Pat. No. 6,077,404 issued to Wang et al. on Jun. 20, 2000 is entitled "Reflow Chamber and Process" teaches the introduction into a re-flow chamber a material that is at least as reactive or more reactive than a material to be re-flowed (i.e. a gettering material). The gettering material is sputter deposited within the re-flow chamber while a shield prevents the gettering material from reaching the material layer to be re-flowed.

U.S. Pat. No. 6,027,631 issued to Broadbent on Feb. 22, 2000 is entitled "Electroplating System with Shields for Varying thickness Profile of Deposited Layer" teaches an electroplating system including shields for controlling the thickness profile of a metal electrodeposited onto a substrate. The shields are position between the anode and the cathode in a standard electroplating apparatus with a device for rotating the plating surface.

U.S. Pat. No. 6,156,167 issued on Dec. 5, 2000 to Patton et al. is entitled "Clamshell Apparatus for Electrochemically Treating Semiconductor Wafers" teaches an apparatus having a cup with a central aperture defined by an inner perimeter. A compliant seal member is adjacent the inner perimeter for pressing against the substrate. A plurality of electrical contacts adjacent the compliant seal member makes electrical contact with the substrate. A cone member is attached to a rotatable spindle so that the cup and the cone define a cavity with the plurality of electrical contacts located therein. In addition a pressurized gas is contained in the cavity. The seal member forms a seal with the perimeter region of the wafer surface preventing plating solution from contaminating the wafer edge, wafer backside and the contacts.

U.S. Pat. No. 6,284,121 issued to Reid on Sep. 4, 2001, is entitled "Electroplating System Including Additive for Filling Sub-Micron Features" teaches a standard electroplating apparatus using an acid copper bath with an additive for leveling. The additive is chosen to have molecules of a size that is about the size of the features to be filled by the electroplating process. The relatively large size of these additive molecules tends to hinder the mass transfer of the additive molecules into the features. Consequently, the additive molecules are preferentially absorbed by the surface of the plating surface relative to the inner surfaces of the features. The electroplating process tends to fill the features relatively quickly compared to the other parts of the target surface so that all of the surface area of the target is equivalent in height. With little or no additive molecules within the features, the features tend to be filled without voids.

U.S. Pat. No. 4,435,266 Issued to Johnston on Mar. 6, 1984 entitled "Electroplating Arrangements" teaches a particular electroplating arrangement having use in the manufacture of stamper plates for disc record production. This apparatus teaches the flow path from the reservoir through the anode area for cleaning the anode bag and removing suspended impurities. The impure electrolyte subsequently passes out of the cell through a valve where it is filtered before returning to the reservoir. This is similar to FIG. 1 herein below.

It is submitted that none of the above patents discuss maintaining the purity of the electrolyte. In those systems that attempt to maintain the purity of the electrolyte, there is a process for maintaining the purity of the electrolyte that have as one disadvantage a higher electrolyte cost by requiring more electrolyte and another disadvantage of having to disposed of the removed electrolyte or waste electrolyte.

It is therefore an advantage of the preferred embodiment to control the electrolyte stability in a copper electroplating process with a very economical procedure.

It is yet another advantage of the preferred embodiment to provide an in-line and real-time control of the organic compounds and impurities in the electrolyte during the plating process.

SUMMARY OF THE INVENTION

These advantages are solved by a system for maintaining stable plating performance in copper electrochemical plating comprising an electrolyte tank containing the copper-plating electrolyte. An electroplating cell adapted to receive IC devices to be plated, receives the copper-plating electrolyte from the electrolyte tank.

A first valve is interposed the cell and a micro-filter and is operable to control the flow of the copper plating electrolyte from the cell to the micro-filter.

A second valve is interposed the cell and a carbon-filter and is operable to control the flow of the copper plating electrolyte from the cell to the carbon-filter for removing additives from the electrolyte.

A programmable controller has a memory, several input circuits, valve control circuits, output circuits, and analysis control circuits and is operable to control the first and second valves in such a mutually exclusive manner that the copper plating electrolyte flows from the cell to only one of the filters.

An algorithm is stored in the memory of the programmable controller and is responsive to the several inputs measuring the plating process for opening one of the valves and closing the other of the valves for controlling the flow of the copper-plating electrolyte.

BRIEF DESCRIPTION OF THE DRAWINGS

These and other advantages are found in the following drawings wherein.

DETAILED DESCRIPTION OF THE PREFERRED EMBODIMENT

The copper plating system is a typical electroplating deposition system as is well known in the art of electroplating IC devices and the basic system is not the subject of this embodiment. U.S. Pat. No. 6,254,760 issued on Jul. 3, 2001 to Shen et al. and entitled "Electro-chemical Deposition System and Method" is incorporated herein by reference is an example of an electroplating system. The present system is a copper electrochemical system as is found in wafer manufacturing.

The '760 patent teaches, copper and its alloys have lower resistivities than aluminum and significantly higher electomigration resistance as compared to aluminum. These characteristics are important for supporting the higher current densities experienced at high levels of integration and increase device speed. Copper also has good thermal conductivity and is available in a highly pure state. Therefore, copper is becoming a choice metal for filling sub-quarter micron, high aspect ratio interconnect features on semiconductor substrates.

Despite the desirability of using copper for semiconductor device fabrication, choices of fabrication methods for depositing copper into very high aspect ratio features, such as 4:1, having 0.35 $\mu$ (or less) wide vias are limited. As a result of these process limitations, plating, which had previously been limited to the fabrication of lines on circuit boards, is now be used to fill vias and contacts on semiconductor devices.

Figure 1:
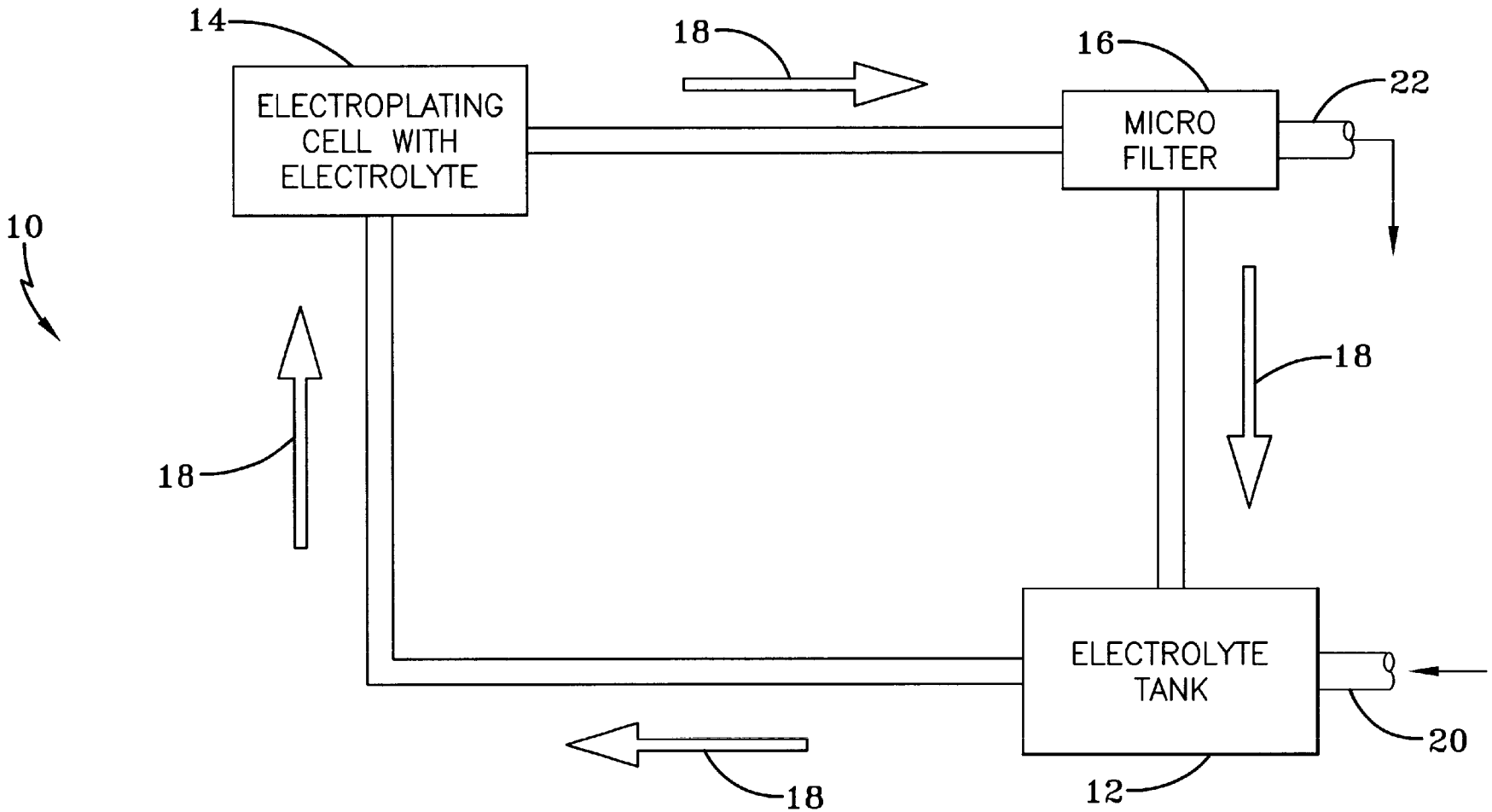
FIG-1 PRIOR ART
FIG. 1 is a block diagram of a prior art system.

Referring to the Figs by the characters of reference, there is illustrated in FIG. 1 a prior art general electroplating system 10. Such a system is described in U.S. Pat. No. 4,435,266 issued to Johnston on Mar. 6, 1984 entitled "Electroplating Arrangements" which is incorporated herein by reference. In the prior art system 10, there is shown as the main parts of the system an electrolyte tank 12, and electroplating cell 14 and a micro-filter 16.

The flow of the electrolyte 18, as illustrated by the arrows 18, is from the electrolyte tank 12 to the electroplating cell 14. The used electrolyte is then supplied to a micro-filter 16 wherein the contaminants are removed from the used electrolyte. After the micro-filter 16, the electrolyte flow 18 is returned to the electrolyte tank 12. The electrolyte tank has an input valve 20 for continuously adding electrolyte to the system as the micro-filter 16 removes contaminated electrolyte through an output valve 22.

Figure 2:
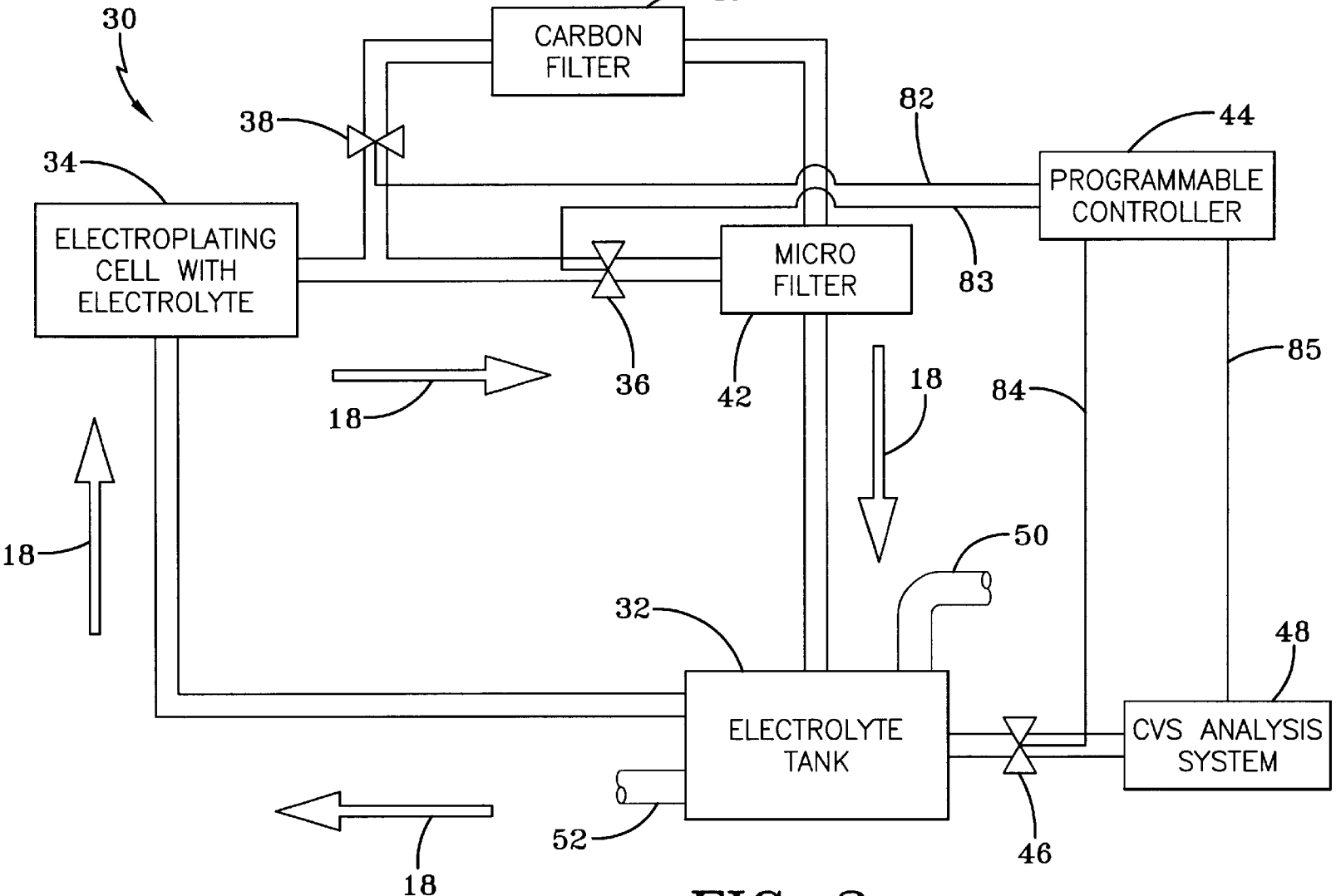
FIG. 2 is a block diagrammatic schematic of the preferred embodiment.

Referring to FIG. 2 there is illustrated the preferred embodiment of the electroplating system 30 of the present invention. Electroplating copper has been used in the IC industry for a long time. In order to have good gap-fill ability, the commercial plating electrolyte that is used has a substance added to it called an "additive". These additives that are different organic polymers for different purposes, must be maintained at a stable level to get a desired gap-fill when plating. Although the additives have importance, they also have the disadvantage in that they will be decomposed into a smaller molecular weight polymer when plating and always stay on the electrolyte. This smaller polymer will be included in the film when plating and cause unknown effects on the process. In an attempt to solve the problem of this polymer staying on the electrolyte, one well-known process refreshes the electrolyte by leaking a percentage of the electrolyte. Still other well-known processes have no useful method to deal with it.

The system 30 of the preferred embodiment which is to have a fresh and stable electrolyte has the electrolyte tank 32, the electroplating cell 34, a first valve 36, a second valve 38, a carbon-filter 40, a micro-filter 42, a programmable controller 44, a third valve 46 and a cyclic voltammetric stripping (CVS) system.

The electrolyte tank 32 is a reservoir of copper plating solution that is supplied into the system 30. The tank 32 has an input 50 for receiving new fresh solution and an outlet 52 for removing old used solution. The flow, as illustrated by the arrows 18, of the copper-plating electrolyte is to an electroplating cell 34 wherein the devices to be electroplated are contained. The process of controlling the devices during the plating and rotating them in the electrolyte is well known.

The flow 18 of the electrolyte leaves the electroplating cell 34 and is controlled by means of a first valve 36 and a second valve 38. The operation of the first and second valves 36, 38.is under the control of a programmable controller 44. An algorithm 54 in the programmable controller 44 will open the first valve 36 and close the second valve 38 so that the flow of the electrolyte flows to the micro-filter 42.

If the programmable controller 44 opens the second valve 38 and closes the first valve 36, the electrolyte flows to a carbon-filter 40 for additional filtering wherein the additives and their byproducts are removed easily from the electrolyte. This results in a stable and high-performance electrolyte without the waste of a percentage of the electrolyte. The electrolyte from the carbon-filter 40 then flows to micro-filter 42 as before.

From the electrolyte tank 32 a third valve 46 is also controlled by the programmable controller 44 to allow a certain volume of electrolyte to flow into a CVS analysis system 48.

Figure 3:
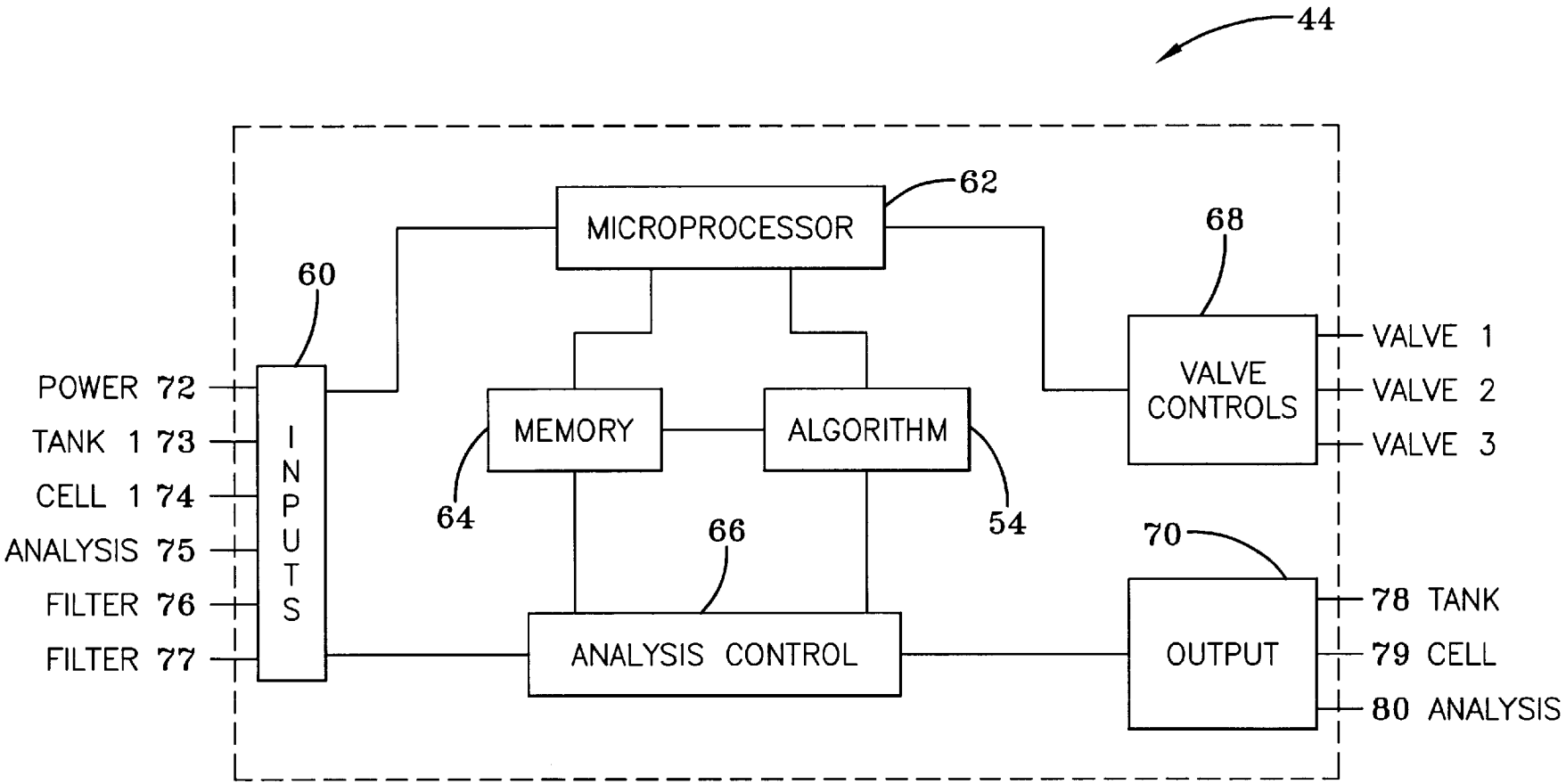
FIG. 3 is a block diagram of the programmable controller.
Figure 4:
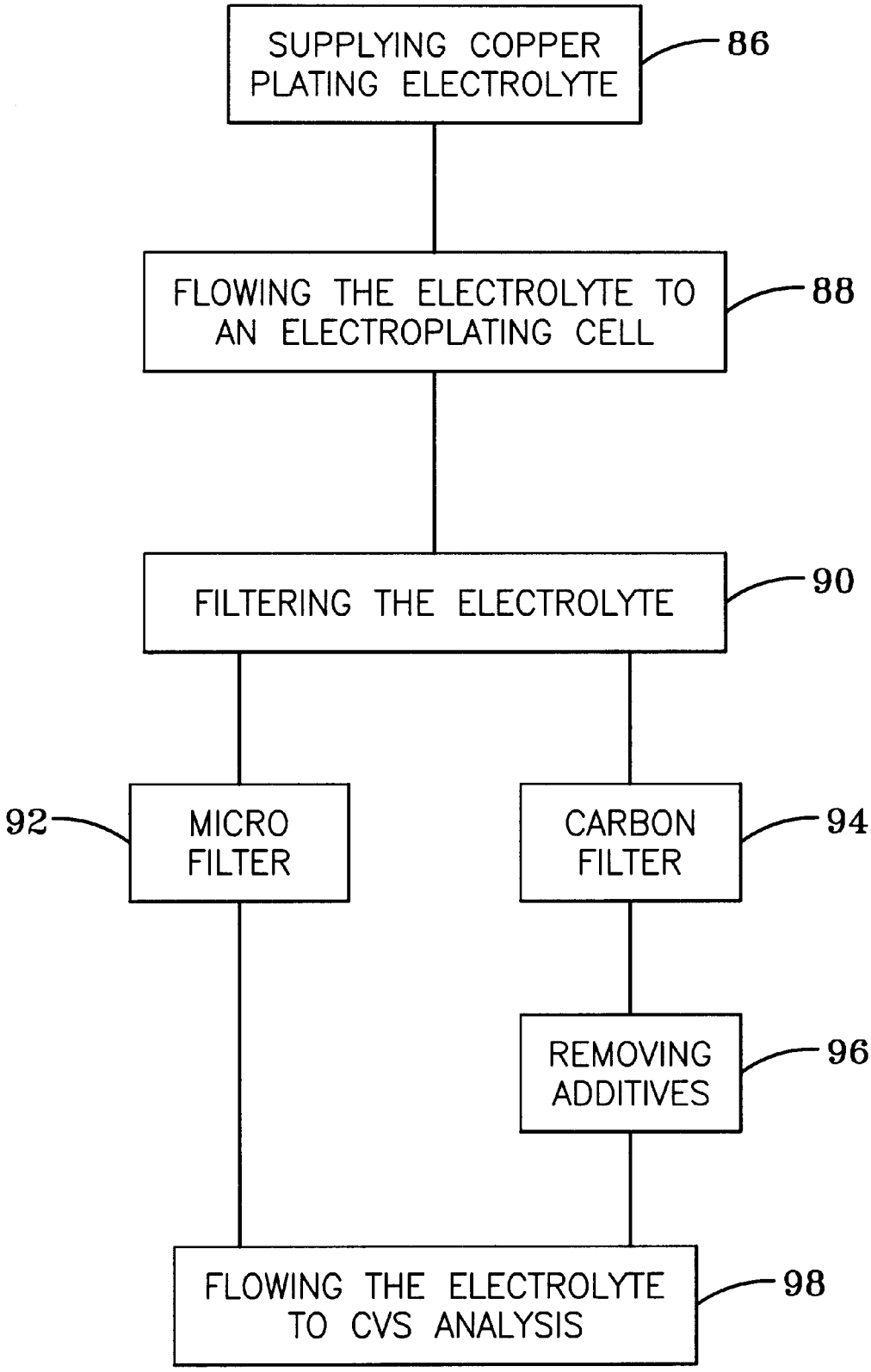
FIG. 4 is a flow chart of the method of the preferred embodiment.

The programmable controller 44 as illustrated in FIG. 3 contains an input section 60, a microprocessor 62, a memory 64, the algorithm 54, a CVS analysis control section 66, valve controls 68 and an output section 70. The input section 60 receives all of the necessary inputs for operating the programmable controller 44 such as power 72, the output of a sensor or sensors from the electrolyte tank 73; the output of a sensor or sensors from the electroplating cell 74; an output from the CVS analysis system 75; and outputs 76, 77 from each of the filters 40, 42. These inputs 72–77 are supplied to the microprocessor 62 wherein they are inputted to the algorithm 54 for the operation of the programmable controller 44. The algorithm 54 is stored in the memory 64 and also provides control to the analysis control section 66.

The microprocessor 62 through its valve control section 68 controls the opening and closing of the first valve 36 and the simultaneous closing and opening of the second valve 38 so that the flow 18 of the electrolyte is to either the carbon-filter 40 or to the micro-filter 42.

The sensors located in the filters 40, 42 supply sensed signals to the programmable controller 44 to provide the algorithm 54 with the information as to the condition of the electrolyte.

The algorithm 54 through the microprocessor 62 also controls the operation of the third valve 46 to cause the electrolyte to flow to the CVS analysis system 48. Thus, the programmable controller 44 controls the electrolyte automatically during the plating process. Hence the process provides a more stable throughput of completed plated wafers.

The programmable controller 44 through its output section 70 also has control lines 82–85 to the first valve 36, the second valve 38 and CVS analysis system 48 to make sure that the process of the electrochemical plating is correct. This results in a real-time and in-line control of the organic compounds and the impurities in the electrolyte and throughput of the plating system.

The present system 30 has a method for controlling the stability of the electrolyte in a copper electrochemical process. The process comprises the steps of supplying 86 a tank or reservoir of copper plating electrolyte. Flowing 88 the electrolyte from the electrolyte tank to an electroplating cell wherein a plurality of devices has been placed therein to be plated.

Then a step of filtering 90 the electrolyte through a micro-filter 92 after it flows through a first valve from the cell. During the process, under control of the programmable controller, a second valve controls the flow of the copper-plating electrolyte from the cell through a carbon-filter 94 to remove additives 96. The controlling the flow of the electrolyte is by mutually exclusive valves.

Additives are removed from the flow of the electrolyte by a carbon-filter coupled to the cell by the second valve. A programmable controller controls the first and second valves in such a manner that the copper plating electrolyte flows from the cell to only one of the filters.

An algorithm is stored in the memory of the programmable controller that is responsive to the several inputs measuring the plating process for opening one of the valves and closing the other of the valves for controlling the flow of the copper plating electrolyte.

The method additionally including flowing the copper-plating electrolyte through a cyclic voltammetric stripping, CVS, system 98 connected to the tank under the control of the programmable controller. The valve controls in the programmable controller control the flow of the copper-plating electrolyte through a third valve from the electrolyte tank to the cyclic voltammetric stripping system.

There has thus been shown and described a new system and a new method for controlling the stability of the electrolyte in a copper electrochemical plating system. The system and the method have a real time, on-line programmable controller to control the flow as well as the content of the electrolyte as respects the organic compounds and impurities that become a part of the electrolyte during the plating process.

While the present invention has been described in an illustrative manner, it should be understood that the terminology used is intended to be in a nature of words of description rather than of limitation.

Accordingly, various changes and modifications may be made to the illustrative embodiment without departing from the spirit or scope of the invention. It is to be appreciated that those skilled in the art will readily apply these teachings to other possible variations of the inventions. However, it is intended that the scope of the invention not be limited in any way to the illustrative embodiment shown and described but that the invention be limited only by claims appended hereto.

What is claimed is:

1. A system for maintaining stable plating performance in copper electrochemical plating IC devices comprising:

an electrolyte tank containing the copper-plating electrolyte;

an electroplating cell receiving said copper plating electrolyte from said electrolyte tank, said cell adapted to receive the IC devices to be plated;

a micro-filter receiving said copper plating electrolyte from said cell;

a first valve interposed said cell and said micro-filter, said first valve is operable to control the flow of said copper plating electrolyte to said micro-filter;

a carbon-filter coupled to said cell for receiving said copper plating electrolyte from said cell, said carbon-filter for removing byproducts of additives from said electrolyte, said electrolyte flowing to said micro-filter from said carbon-filter;

a second valve interposed said cell and said carbon-filter, said second valve operable to control the flow of said copper plating electrolyte from said cell to said carbon-filter;

a programmable controller having a memory, input circuits, valve control circuits, output circuits, and analysis control circuits, said controller operable for controlling said first and second valves in such a manner that said copper plating electrolyte flows from said cell to one of said filters; and an algorithm stored in said memory of said programmable controller and responsive to several inputs measuring a plating process for opening one of said valves and closing the other of said valves for controlling said flow of the copper plating electrolyte.

2. The system according to claim 1 additionally including;

a cyclic voltammetric stripping, CVS, system connected to said tank; and a third valve operatively interposed said electrolyte tank and said cyclic voltammetric stripping system, said third valve operatively controlled by said valve controls in said programmable controller.

3. The system according to claim 1 wherein said programmable controller operates in real time and on-line, wherein said programmable controller controls said flow and said byproducts from said electrolyte during said plating process.

4. A method for controlling the stability of the electrolyte in a copper electrochemical plating of IC devices comprising the steps of:

supplying a tank of copper plating electrolyte;

flowing the copper-plating electrolyte from the electrolyte tank, to an electroplating cell;

placing the IC devices to be plated in the electroplating cell;

filtering through a micro-filter the copper-plating electrolyte flowing from the cell;

controlling through a first valve the flow of the copper-plating electrolyte to the micro-filter;

controlling through a second valve the flow of the copper-plating electrolyte from the cell;

removing additives from the electrolyte from the cell through a carbon-filter coupled to the cell and the second valve, said electrolyte flowing to said micro-filter from said carbon-filter;

controlling by a programmable controller the first and second valves in such a manner that the copper plating electrolyte flows from the cell to only one of the filters; and storing in the memory of the programmable controller an algorithm responsive to several inputs measuring a plating process for opening one of the valves and closing the other of the valves for controlling the flow of the copper-plating electrolyte.

5. The method according to claim 4 additionally including;

flowing the copper plating electrolyte through a cyclic voltammetric stripping, CVS, system connected to the tank; and controlling the flow of the copper-plating electrolyte through a third valve from the electrolyte tank to the cyclic voltammetric stripping system by valve controls in the programmable controller.

6. The method according to claim 4 wherein the step of controlling the first valve and the second valve is a mutually exclusive operation wherein only one of the valves is open and the other valve is closed.

7. The method according to claim 6 wherein the first valve and second valve are mutually exclusive in operation.

8. The system according to claim 1 wherein said micro-filter and said carbon-filter include sensors to provide information indicative of a condition of said electrolyte.

9. The method according to claim 4 wherein said micro-filter and said carbon-filter include sensors to provide information indicative of a condition of said electrolyte.

* * * * *